US005660118A

United States Patent [19]

Adams, Jr.

[11] Patent Number: 5,660,118

[45] Date of Patent: Aug. 26, 1997

[54] RECYCLABLE FORK SHEET

[76] Inventor: Stephen Curtis Adams, Jr., 14605 SE. 45th St., Bellevue, Wash. 98006

[21] Appl. No.: 552,825

[22] Filed: Nov. 3, 1995

[51] Int. Cl.[6] ..... B65D 19/20

[52] U.S. Cl. ..... 108/51.3; 108/51.1; 248/346.02

[58] Field of Search ..... 108/51.1, 51.3; 248/346.01, 346.02

[56] References Cited

U.S. PATENT DOCUMENTS

| | | | |
|---|---|---|---|
| Re. 29,192 | 4/1977 | Anderson et al. . | |
| 2,913,206 | 11/1959 | Paris . | |
| 4,022,135 | 5/1977 | Bauman, Jr. et al. . | |
| 4,042,127 | 8/1977 | Brossia . | |
| 4,284,259 | 8/1981 | McCaskill . | |
| 4,467,004 | 8/1984 | Liebel . | |
| 4,507,348 | 3/1985 | Nagata et al. | 108/51.1 X |
| 4,570,546 | 2/1986 | Batelka . | |
| 4,986,418 | 1/1991 | Gwathmey | 108/51.3 X |
| 5,062,370 | 11/1991 | Etlinger | 108/51.3 |
| 5,111,754 | 5/1992 | Adams, Jr. . | |
| 5,291,837 | 3/1994 | Adams, Jr. . | |

FOREIGN PATENT DOCUMENTS

| | | | |
|---|---|---|---|
| 404087944 | 3/1992 | Japan | 108/51.3 |

*Primary Examiner*—Jose V. Chen
*Assistant Examiner*—Hanh V. Tran

[57] ABSTRACT

A pallet is provided for unitized loads of products which pallet is adapted for handling by forklift devices. The pallets are constructed by affixing angle board along the bottom surface of substantially all of at least one edge of a flat sheet of a relatively stiff recyclable paper product such as corrugated board, laminated paperboard, or fiberboard.

3 Claims, 2 Drawing Sheets

RECYCLABLE FORK SHEET

BACKGROUND OF THE INVENTION

The invention relates to pallets made of all paper products which serve as bases for unitized loads of products which are adapted for handling by forklift devices.

Since about the turn of the century the wooden shipping pallet has been the cornerstone of materials handling. It has long been recognized that the wooden pallet is too heavy, bulky, and tremendously wasteful of increasingly scarce forest resources. For over fifty years attempts have been made to provide improved alternatives to the wooden pallet. At the present time the slip sheet is the most widely used alternative to the wooden pallet, although other pallet designs, such as the all paper device shown in U.S. Pat Nos. 5,111,754 and 5,291,837, and composite wood/paper constructions have achieved some market penetration. However, the wooden pallet continues to dominate the materials handling market.

SUMMARY OF THE INVENTION

A pallet is provided for unitized loads of products adapted for handling by forklift devices. The pallets are light weight, occupy a minimum space, are completely recyclable and work with common forklift devices. The straight forward construction of the pallet of the invention makes them particularly suitable for assembly in sheltered workshops, such as those run by Goodwill Industries to employ handicapped people, which workshops are strategically located throughout the United States. The pallet comprises a general flat sheet of a relatively stiff paper product having angle board affixed along the bottom surface of substantially all of at least one edge of the flat sheet and to a depth of at least about one inch, the angle board extending vertically at least about one inch above the top surface of the flat sheet.

DETAILED DESCRIPTION OF THE INVENTION

Figure 1:
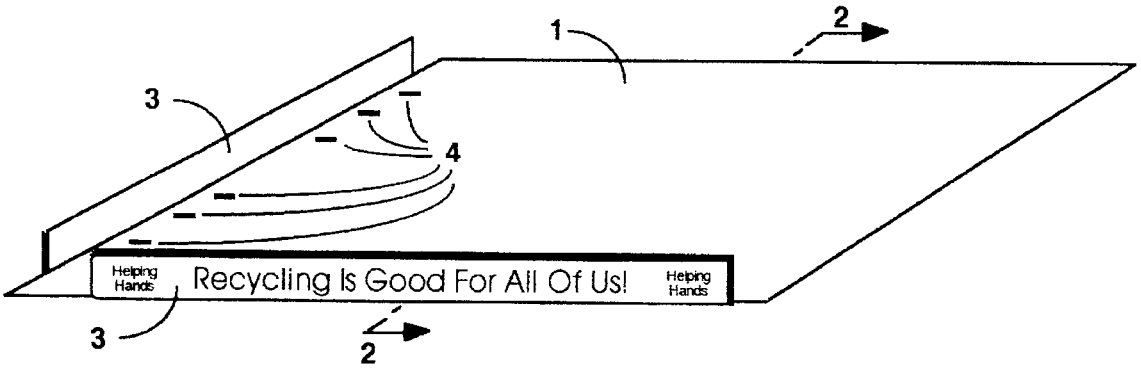
FIG. 1 is a respective view of one embodiment of the invention.
Figure 2:
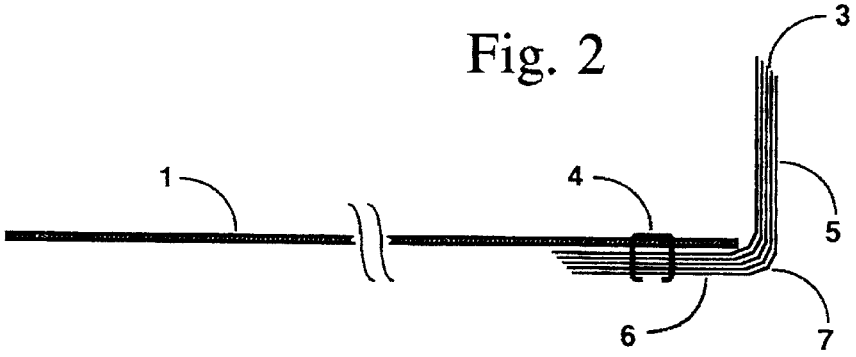
FIG. 2 is a cross-sectional view as indicated by the arrows 2—2 of FIG. 1.

Referring to the drawings, the pallet of the invention is shown in FIGS. 1 and 2. The pallet comprises a flat sheet 1 to which are affixed two sections of angle board 3. The bottom 6 of the angle board 3 is secured to the bottom of flat sheet 1 by staples 4. While staples are preferred, other means of affixing the angle board 3 to the flat sheet 1, such as glue, may be used if desired. If staples are used, the length of the staple should be perpendicular to the vertical side 5 of angle board 3 and, thus, to the edge of sheet 1. This reduces the possibility of the tines of the forklift device catching and tearing out one or more staples. The number of staples used will depend on the size of the staples, the strength of the angle board, the strength of the flat sheet, and the weight of the load with which the pallet is to be used.

Flat sheet 1 may be made of any recyclable paper product such as corrugated board, laminated paperboard or fiberboard. The weight and type of paper product should be selected to provide the strength needed for the particular application. Thus if laminated paperboard (the material frequently used for slipsheets) is used for the flat sheet, the thickness may vary from about 25 to 125 thousandths of an inch. If fiberboard is used, greater thickness is needed and generally will be in the range of about 50 to about 250 thousandths of an inch. For use over a wide range of load weights (i.e., from about 100 up to about 5000 lbs.) it is preferred to use fiberboard about 100 thousandths of an inch thick.

Angle board is a standard product principally used to secure the vertical corners of a unitized load of products. It is a rigid recyclable paper product made by laminating several layers of paper or paperboard together which are formed to produce two sides of about equal width at approximately a right angle to each other. Normally the angle will be between 75° and 90°. Generally the sides are between one and four inches wide and the board may be cut into any desired length. The thickness typically will be between 1/16 and 1/4 of an inch. It is preferred to use angle board which is about 180 thousandths of an inch thick. In the pallet of the invention sides one inch wide will generally permit adequate fastening strength. Wider sides, say about two inches each, should be used for obtaining greater strength and/or for providing a larger area on which to display advertising and promotional messages on the vertical side 5 as shown in FIG. 1. It is preferred to use angle board whose sides are two to two and a half inches wide. The rounded angle of the angle board, plus the extra thickness of the angle board, assists the entry of the tines of a forklift device under the bottom of flat sheet 1 without entering sheet 1 and damaging the load.

The embodiment shown in FIG. 1 illustrates angle boards 3 affixed to two adjacent sides of flat sheet 1. This provides entry by the tines of a forklift device from either of the two sides. Such an embodiment permits pinwheeling. A standard pallet is 40×48 inches. Federal law for some time limited truck trailers to an eight foot width. That has recently been changed to one hundred two inches, but large numbers of the old trailers are still in use. Subtracting the thickness of the trailer walls, the width available for the load is less than 96 inches. Accordingly, two pallets cannot be loaded with their long dimensions across the width. On the other hand, if the pallets are loaded with their short dimensions across the width, valuable space is wasted. Loading the pallets so that one long dimension and one short dimension are across the width of the trailer permits more efficient utilization of trailer space. This is called pinwheeling and requires a pallet that provides two way entry as shown in FIG. 1. If desired, the pallet of the invention may also be made to provide one way, three way, or four way entry by affixing the angle board to one, three, or all four sides of sheet 1.

The angle board extends for substantially the full length of the side to which it is affixed. If desired, the angle board may be slightly shorter than the edge to which it is affixed, i.e., not more than about two inches at each end, and should be centered on the edge of sheet 1. This construction does not compromise the rigidity afforded to the edge during entry of the forklift tines and permits an additional adjustment in pallet width to accommodate the unitized load while permitting maximum utilization of trailer dimensions.

On heavier loads, the pallets of the invention are preferably used with forklift devices equipped with fully tapered tines. With lighter loads, i.e., those of a thousand pounds or less, the more common chiselpoint tines can be used. When one pallet load is placed on top of another, an extra pallet of the invention should first be placed on the top of the bottom unitized load with the pallet inverted so that the vertical side of the added pallet hangs down.

Figure 3:
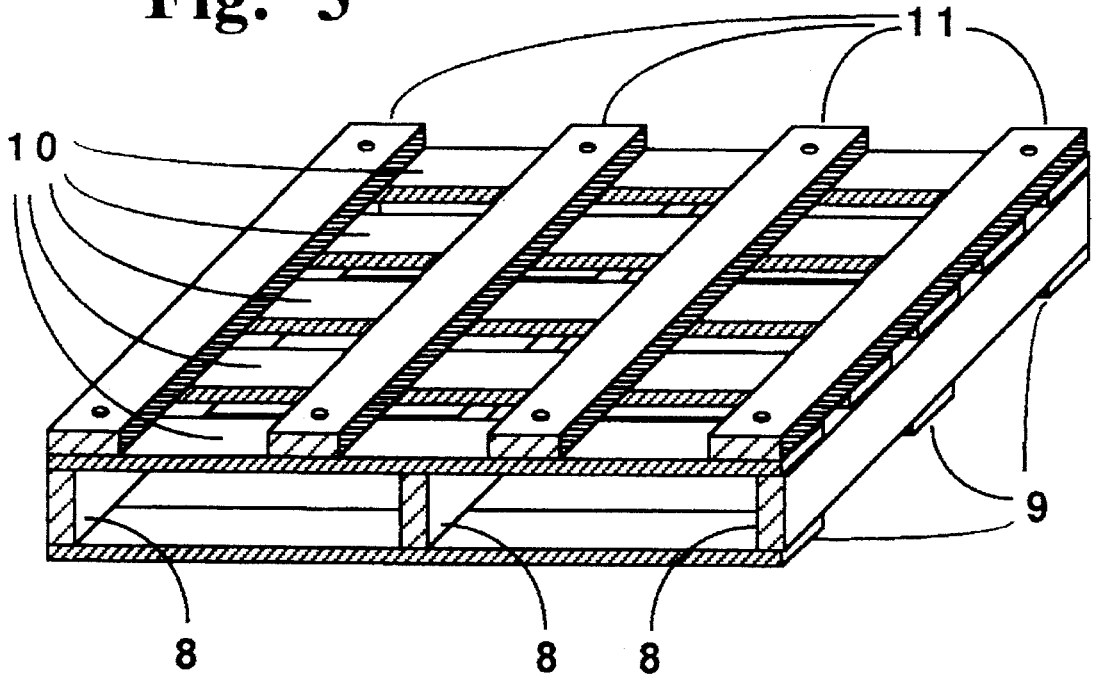
FIG. 3 is a respective view of a slave pallet which may be used with the pallet of the invention.

When unitized loads of products are generated using the pallets of the invention as bases for the loads, there will normally be a backstop provided by another palletized load, a warehouse wall, truck trailer bulkhead, etc. However, if there is no backstop, a slave pallet should be used to prevent the pallet and the unitized load thereon from sliding as the forklift tines seek to enter under the pallet. A suitable slave pallet is shown in FIG. 3. As shown a regular wooden pallet comprising vertical supports 8, bottom supports 9, and top supports 10 is modified by nailing four parallel standard two×fours 11 on the top supports 10 forming channels about 1¾ inches high. To use the slave pallet, a pallet of the invention is placed on top of the slave pallet and a unitized load is created on the pallet. When the unitized load is finished, the tines of the forklift easily enter the channels provided by the two by fours without any sliding of the pallet of the invention and its associated load.

If desired, the angle board and flat sheet used in the pallets of the invention may be treated for water resistance and/or have non-skid surface coatings applied.

What is claimed is:

1. A paper pallet which serves as a base for a unitized load of products consisting essentially of a generally flat sheet of a relatively stiff recyclable paper product having at least one edge, a bottom surface and a top surface, and an angle board of stiff laminated recyclable paper product; wherein the angle board having a first portion affixed along the bottom surface and substantially all of and inwardly to a depth of at least one inch from said at least one edge of the flat sheet, and a second portion extending at an angle of from about 75° to 90° from the first portion and at least one inch above the top surface of the flat sheet.

2. The pallet of claim 1 wherein the laminated paper product is stapled to the flat sheet.

3. The pallet of claim 1 where there are angle boards affixed to two adjacent sides of the flat sheet.

* * * * *